United States Patent [19]

Baum

[11] Patent Number: 4,643,105

[45] Date of Patent: Feb. 17, 1987

[54] TABLE TOP SUPPORT

[75] Inventor: Elliott W. Baum, St. Louis County, Mo.

[73] Assignee: Berco Industries, Inc., St. Louis, Mo.

[21] Appl. No.: 711,258

[22] Filed: Mar. 13, 1985

[51] Int. Cl.[4] ..... A47B 13/02

[52] U.S. Cl. ..... 108/150; 108/4/157

[58] Field of Search ..... 108/150, 4, 1, 124, 108/157, 153, 115, 131, 6; 16/321, 348, 267, 257, DIG. 13, 380; 292/17, 76; 248/432

[56] References Cited

U.S. PATENT DOCUMENTS

| | | | |
|---|---|---|---|
| 609,592 | 8/1898 | Shultz | 108/157 X |
| 1,122,205 | 12/1914 | Ingells | 108/153 X |
| 3,940,181 | 2/1976 | Cheek, Jr. | 106/6 X |
| 3,993,004 | 11/1976 | Alme | 108/150 X |
| 4,112,855 | 9/1978 | Colby | 108/124 X |
| 4,297,953 | 11/1981 | Shy | 108/131 |

FOREIGN PATENT DOCUMENTS

| | | | |
|---|---|---|---|
| 443392 | 9/1912 | Fed. Rep. of Germany | 16/267 |
| 266084 | 1/1913 | Fed. Rep. of Germany | 108/150 |
| 2458245 | 2/1981 | France | 108/6 |
| 824985 | 12/1959 | United Kingdom | 16/267 |

*Primary Examiner*—Kenneth J. Dorner
*Assistant Examiner*—José V. Chen
*Attorney, Agent, or Firm*—Paul M. Denk

[57] ABSTRACT

A table top support for use in securing the top of a table to its upstanding column, the support incorporating a first base member securing to the top of the column, a second and connectible member securing to the underside of the table top, various recesses provided within the base member and connectible member disposed for reception of shafts operatively associated with both of said base and connectible members, to provide stable support for the table top into its usable and horizontal position, but each recess including at offset portion for reception of a support shaft therein so as to facilitate the stable adherence of the support members together as the table top is pivoted into its vertically arranged and storage condition.

8 Claims, 21 Drawing Figures

TABLE TOP SUPPORT

BACKGROUND OF THE INVENTION

This invention relates generally to supporting structures, and more specifically pertains a unique and useful support for stably holding a table top upon its columnar support, and which support is useful for stably holding the table top as it is pivoted into a nonoperative and storage condition.

Space savings in commercial and institutional settings has always been of concern, since while it may be desirable within a dining or conference setting to have a plurality of tables arranged throughout a hall for accommodating the seating of participants, frequently it becomes desirable or necessity to remove and clear the table laden space from all of its disposed furniture. Hence, it has long been the desire to create tables that not only are attractive from an aesthetic standpoint, but which can also be easily removed if that becomes a necessity.

For example, a collapsible table, or a one which has foldable legs, has always been a value to the trade, but such tables are quite weak in structure, and have a tendency to be rather unstable during usage, usually to the participants dissatisfaction.

Prior inventors have attempted to alleviate this problem associated with saving space in the setting where tables are erected, but yet provide a table that is very stable in structure, and still be very pleasing in appearance during its application and usage. Tables of this nature generally have been designed around the concept of providing some foldable feature to its table top, so that it may be either removed from its supporting post, or perhaps tilted in relationship thereto. Then, when arranged in the tilted position, obviously the width of the entire table structure becomes substantially reduced so that a variety of such tables can be stacked one against the other as against a wall, in order to use a minimum of space requirements as when the tables are maintained in such storage.

Examples of the aforesaid type of table construction is shown in the United States patent to Alme, U.S. Pat. No. 3,993,004. As disclosed therein, the table post incorporates a mechanism or assembly that permits pivoting of its table top between the horizontal and into a substantially vertical position as shown. While the configured mechanism may be satisfactory for performing its intended function, the current invention, in the alternative, is structured in a manner wherein its various operating components add substantial stability to the support of the table top upon its column, and further allows for direct vertical lifting of the table top from its horizontal position, or can attain its pivoting into the nonusable condition, and further can be removed therefrom under that condition. In addition, locking mechanism is provided for assuring the retention of the table top in place, to add to its stability during performance.

It is, therefore, the principal object of this invention to provide a releasable table top support wherein it firmly holds and secures its table top in place upon the supporting column during table usage, but likewise affords a pivoting, under conditions that assure the retention of the table top pivot means in place during such action, so as to prevent an untimely and undesired loosening or dropping of the table top while being tilted into its nonoperative position.

Another object of this invention is to provide a table top support which is cast of structural steel or cast iron, and therefore has significant structural integrity for providing a firm mounting of the table top securely upon its columnar support.

Another object of this invention is to provide a removable table top type of support that incorporates locking means for firmly affixing the table top to its column as during table usage.

Still another object of this invention is to provide a support for a table top that is firmly held in place by means of fasteners, or the like, but which can be readily removed and replaced as required.

Yet another object of this invention is to provide a support for a table top and which allows for its tilting in two different directions, at opposite sides of its column support, as may be desired.

Yet another object of this invention is to provide a support for a table top and wherein the top, when desired for removal, can simply be lifted vertically for disengagement from its columnar support.

A further object of this invention is the provision of shaft means entirely across its support for stably retaining the table top, and substantially free of any looseness as during routine application.

These and other objects may become more apparent to those skilled in the art upon reviewing the summary of this invention, and upon undertaking study of the description of its preferred embodiment in view of the drawings.

SUMMARY OF THE INVENTION

This invention contemplates the formation of a removable style of support that adds hingability to the mounting a table top upon its column, so that the top cannot only be lifted free of its column at any time, and regardless of the angular disposition of the top during its pivoting with respect to its column, but in addition, means are provided for sustaining the gravity hold of the top upon the support, during its shifting, all without the need of any additional fasteners. But, in addition, the invention considers the application of locking means to assure that the table top will be stably held in place affixed upon its columnar support, as during table usage, to assure that firm stability is provided to the table during its usage, and that it does not wobble or shake as frequently occurs, as previously described, with respect to tables that normally incorporate the collapsible style of legs.

This invention is formed having a hinged style of support connecting intermediate the table top, and at the top of its supporting column, with the support incorporating a first base member that is rigidly affixed to the top of the table column, while the second and connectible member secures to the underside of the table top, and which cooperates and mates with the base member for affording the various attributes previously described to the table top support of this invention.

The base member incorporates a recess therein, and one which also includes a slightly off centered portion, and into which a first pivotal shaft interconnecting between the spaced apart components forming the connectable member inserts, so that this connectable member shaft, as held in place, conveniently can be slid into mounting within the base member recess, across its entire width, and provide the focal point for pivoting of the table top with respect to its column. In addition, and to secure and firmly hold the table top into its horizontal and usable position, the base member further includes another shaft, that either extends through it at its other or opposite approximate edge, or which incorporates a pair of stub shafts that extend slightly laterally of the formed base member, and which are disposed for inserting engagement within additional recesses formed into the opposite edge of the components of the connectable member, which latter recesses are aligned with the spur or stub shafts laterally extending from the said base member. Thus, when the table top is in place, upon its columnar support, it is firmly and stably mounted into its horizontal position, with the various shafts and recesses of the respective base and connectable members being arranged at those positions that afford a precisely horizontal positioning of the table top as fully shaft supported upon its column and base. Then, as pivoting occurs of the table top, as between its usable and horizontal position, into its tilted and near vertically disposed position, the offset shape of one or both of the defined recesses provides a position into which the pivot shaft, or stub shafts, may locate, so as to assure that the table top remains connected to its column support, or the base member, and does not slide clear or free of the same which could otherwise cause injury to the maintenance person manipulating the table from either its operative to the nonoperative condition, or vice versa.

Locking means is provided in the form of a pivotal latch securing with the underside of the table top, an aligned and formed slot provided in one end edge of the base member, so as to assure a locking engagement of the table top in place, and to prevent its further pivoting, as during usage. For example, should someone lean upon the table top, during usage, and should the locking member be inadvertently disengaged, there could be the possibility that the table top would pivot downwardly, under the weight of the force exerting party, which would create and undesirable condition. But, with the engagement of the locking member of this invention, such a condition cannot prevail. But, the locking member can be easily disengaged, when desired, so the workmen can either remove the table top, or pivot it into its vertical, or near verical, condition, as when it is desired to stack the tables against the wall during nonusage, or when being located into storage.

BRIEF DESCRIPTION OF THE DRAWINGS

In referring to the drawings, FIG. 1 discloses a perspective view of the table top support of this invention, and also shows in phantom line the connection of the table top and its columnar support therewith.

DESCRIPTION OF THE PREFERRED EMBODIMENT

Figure 1:
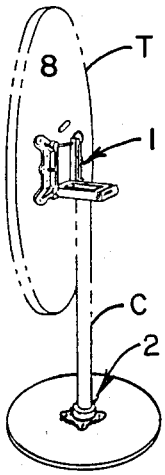
Figure 4:
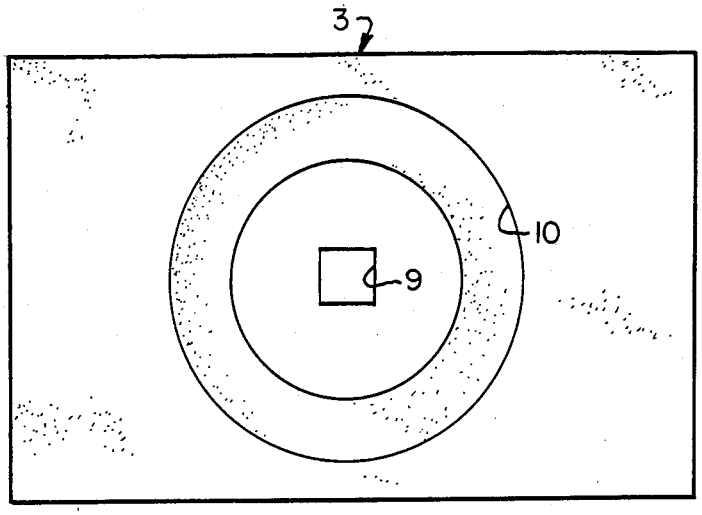
FIG. 4 provides a bottom view of the base member of the table top support of this invention.
Figure 5:
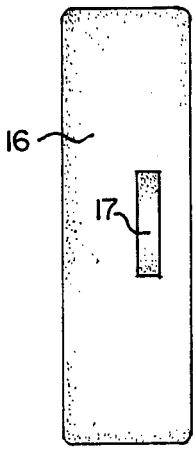
FIG. 5 is an end edge view of the base member showing its locking means slot formed therein.
Figure 6:
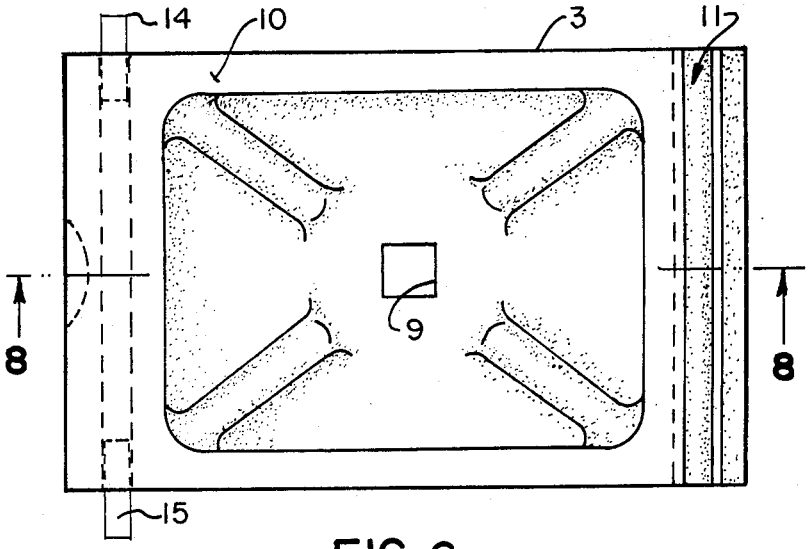
FIG. 6 is a top view of the base member of the table top support of this invention.
Figure 7:
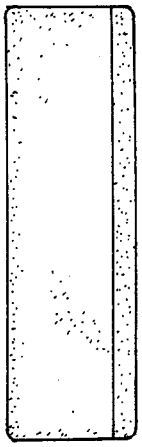
FIG. 7 is an opposite end edge view of the base member shown in FIG. 6.
Figure 8:
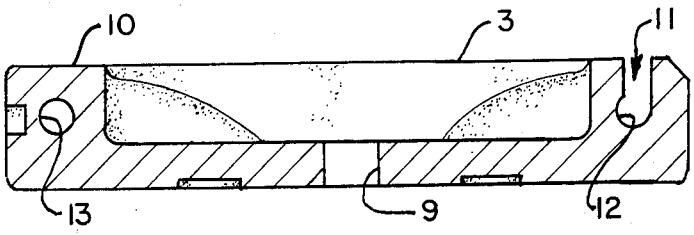
FIG. 8 is a transverse sectional view of the base member taken along the line 8—8 of FIG. 6.
Figure 9:
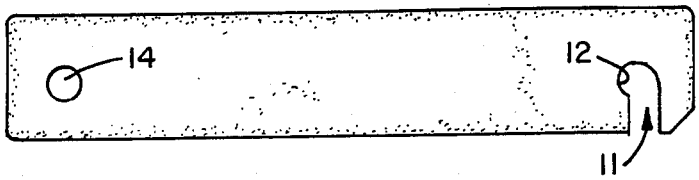
FIG. 9 is a side view of the base member shown in FIG. 6.
Figure 2:
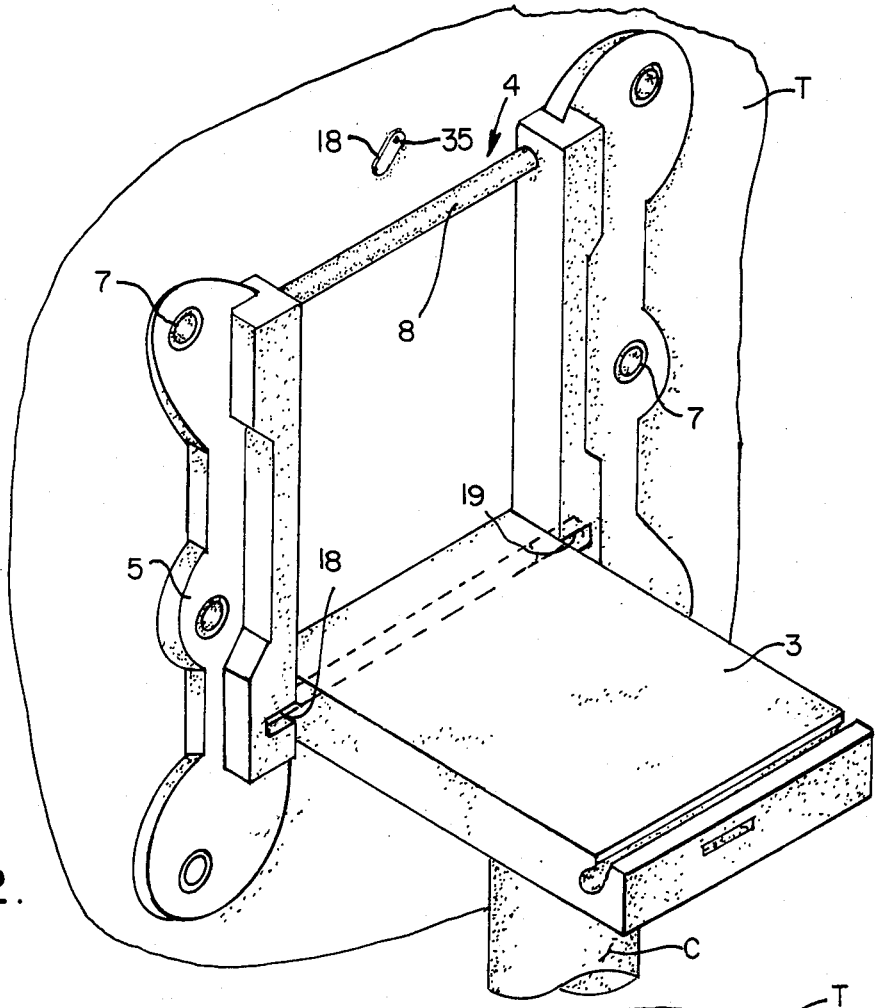
FIG. 2 provides a perspective view of the table top support, when pivoted open.
Figure 3:
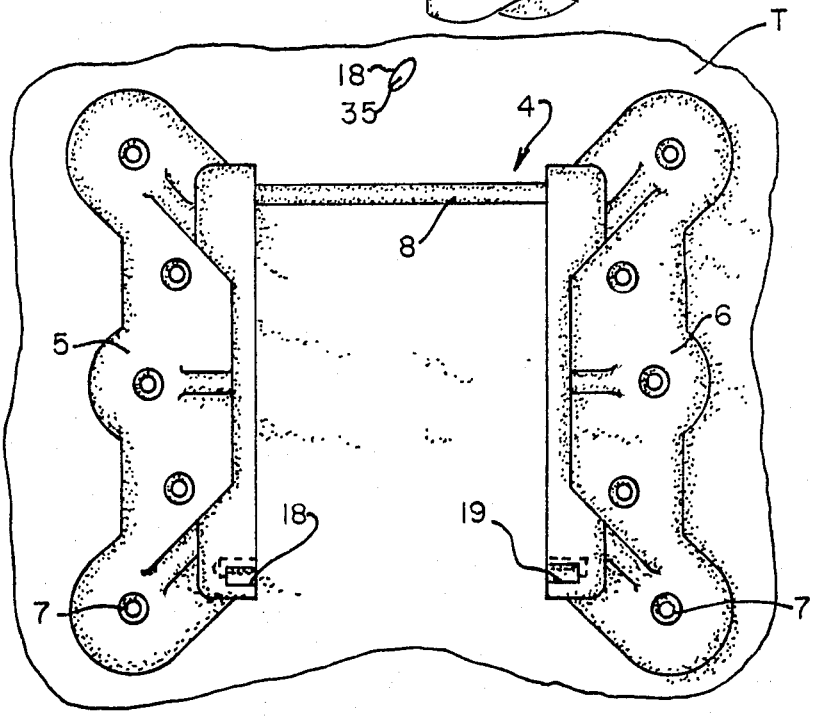
FIG. 3 provides a bottom view of the connectible member of the support.

In referring to the drawings, and more specifically FIGS. 1 through 3, the various concepts of this invention as embodied into a table top support structure are disclosed. As shown, in phantom line, a table top T is mounted upon its column C by way of the support 1 of this invention, with a column base means 2 supporting the table stably upon the floor, or the like. As can be seen, the table has rigidly connected to it a first support or base member 3, which is secured to the top of the column C, as can be noted. And, the first member 3 is pivotally connected with a second support or connectable member 4. These two support members, in operation, as forming the support member of this invention, are releasably hinged together in a manner as will be subsequently analyzed. As can be noted from FIG. 3, the second member of the support is actually formed of a pair of components 5 and 6, being rigidly fixed by means of screws, as shown at 7, or by other fasteners, to the underside of the table top T. And, these components 5 and 6, as can be seen, are spaced apart and intervened by a first shaft means 8 which, as will be subsequently described, cooperates with the first support member 3 for stably holding the table top in place, when erected for usage, or during its pivotal movement.

The first member of the hinged support, as identified at 3, is more particularly disclosed in FIGS. 4 through 9, and as shown, comprises a form of base member, generally being rectangular in configuration, although obviously other shapes may function just as effectively, and the said base member is rigidly connected to the column C of the table structure by means of a bolt, or other fastener, that inserts through the aperture 9 and firmly affixes the said base member to the top of the identified and disclosed column C. And, to assure the stable mounting of the base member upon the column top, and to provide for its proper setting and centering, there may be provided a recessed area, as at 10, upon the underside of said base member, so as to assure a complementary location for seating of the column top having its base member 3 fitted thereon. Any type of spider, or other connecting means, not shown, may be provided within the column top and provide the structural means to which any bolt or other fastening means may rigidly connect said base member to the column. As disclosed upon the top side of the base member 3, as noted particularly in FIGS. 6 and 8, the base member includes rather designed flattened areas, as at 10, at particular locations around its top surface, and at one end of the base member there is provided a recess, as at 11, formed therein, generally extending from one side edge to the other of the formed base member, and the recess, at its inward most end, includes a slightly offset portion, as at 12, and which extends generally towards the column or center of the identified base member. As has been previously explained in this application, this particular recess 11, and its offset portion 12 are designed to cooperate with the shaft 8 of the connectable member, such that when the shaft 8 slides into the recess 11, it is conveniently held in place, and stably supports, due to the shaft's length, and full contact with the width of the base member within its recess, the table top upon the column C, and that when the table top may be pivoted, as in a direction about the shaft 8, the shaft will conveniently seat within the offset portion 12, to provide a convenient retention by way of gravity of the support member together, as during this pivotal shifting of the table top from its operative to its nonoperative position, or vice versa. And, this can be accomplished without too much fear of the table top sliding free of its base member support, since the shaft 8 will be snuggly seated for pivoting within this offset recess 12 of the base member.

In addition to the foregoing, the proximate opposite end of the base member 3 includes an aperture, as at 13, provided therethrough. And, within this aperture another shaft, or a pair of stub or spur shafts, as at 14 and 15, may be rigidly fixed therein, and these particular stub shafts cooperate with the connectable member 4, in a manner as will be subsequently defined, to provide a main pivot point, about which the table top support is releasably but hingably connected as during a pivotal movement conducted between the said table top T, and its column C, in the manner as shown in FIG. 1.

Proximate the one end, as at the end of 16, of the base member 3, is formed a shallow groove or slot 17, and within this slot the latch 18 of the locking mechanism may insert, as it is pivotally forced therein, in order to assure a retention of the table top fixably to its column C, or in the alternative, when it is desired to pivot the table top into its nonoperative condition, once again, as shown in FIG. 1, the latch 18 simply may be pivoted free of the slot 17, which disengages any locking connection between these two components of the table top support.

The hinged connection between the base member 3, and more specifically its shafts 14 and 15, or any single shaft that may be located within the recess 13, is designed to cooperate within additional recesses, as at 18 and 19, formed within each of the components 5 and 6 of the formed connectable member. The locating of the stub shafts 14 and 15 within these formed recesses 18 and 19 can be more accurately seen upon viewing FIG. 2, such that this provides the main pivot point between the two members, namely, the connectable member 4, and the base member 3, forming the table top support, but that, in the alternative, where it is desired to pivot the table top about the shaft 8, such can also be accomplished, simply by lifting an opposite edge of the table top for pivotal movement about the shaft 8 through its locating within the recess 11.

It might be commented that the spacing between the stub shafts 14 and 15, or any individual shaft that may be located within the aperture 13, and that distance from the shaft 8, is such as to provide convenience alignment with the recess 11, of the base member 3, and the recesses 18 and 19, of each component of the connectable member 4, such that the table top can be lifted directly upwardly, from its horizontally operative position, with all of these shafts and recesses becoming conveniently disengaged as when it is desired to simply totally remove the table top from its column. Under this condition, the connectable member 4 will become totally freed from its hinged connection with the base member 3 of the support. In the alternative, as previously explained, it is just as likely that the hinged or pivotal movement of the table top, in the manner as shown in FIG. 1, may be performed about either the shaft 8, or the stub shafts 14 and 15, without disengagment of these two members 3 and 4 of the table top support from each other. It is a matter of choice, dictated by the circumstances under which the table top is to be manipulated, as to whether a quick and total disengagement of the table top from its column is to be affected, or that a simple pivotal movement of the table top upwardly, into its nonoperative and storage position, is to be made.

Figure 10:
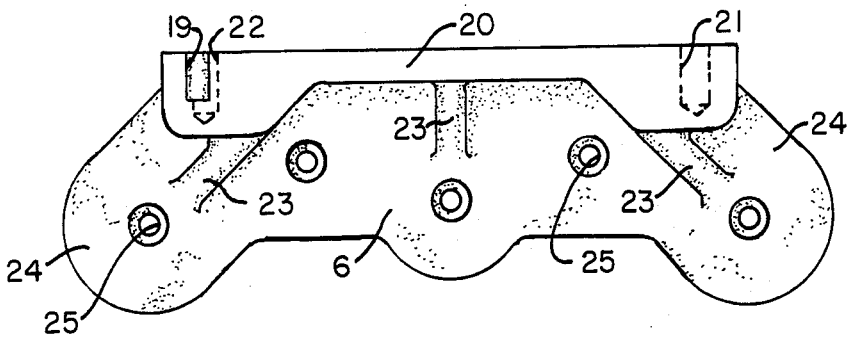
FIG. 10 is a bottom view of one of the components forming the connectable member of this invention.

In referring to FIGS. 10 through 15, the components forming the connectable member 4 are more accurate shown. In this particular instance, each component is formed of the structure as shown in FIG. 10, which comprises the right side component 6 of the formed connectable member. It includes a member which may be metallically cast in order to provide a very stable and structurally capable support, or it may be fabricated of any other materials, as desired, depending upon the degree of stability required for the mounting of the table top upon its column. In any event, each connector includes its operative segment 20 which includes an aperture, as at 21, at one proximate end, and into which the shaft 8 permanently inserts when the connectable member is mounted to the underside of the table top, such as also shown in FIGS. 2 and 3. At the opposite and proximate end of the connector is formed the recess 19, as can be seen, and within the base of this recess is formed, in addition, another offset portion, as at 22, and into which one of the stub shafts 14 or 15 may locate during table top assembly, and provide the means about which the table top may be pivoted as during manipulation, in the manner as previously defined. In addition, various reinforcing ribs, or other structural support, as at 23, is provided in the integral formation of the portion 20 with its flange portions 24, and which also include a series of apertures, as at 25, therein, and through which the screws or other fasteners may locate when firmly adhering the connectable member with the underside of the table top, once again, as completely shown in FIG. 1.

Figure 13:
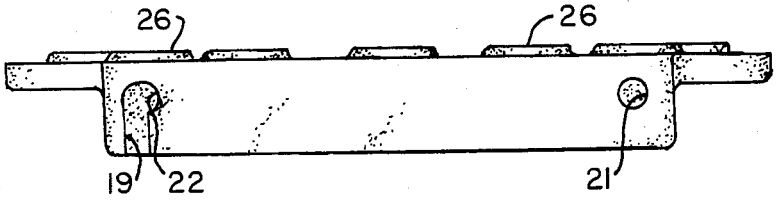
FIG. 13 is an opposite or interior side view of the component of FIG. 10.
Figure 14:
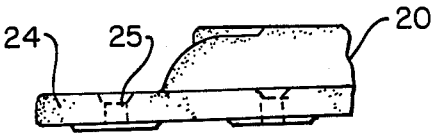
FIG. 14 is an end view of the component.
Figure 15:
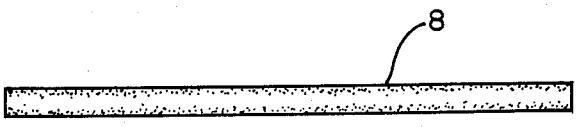
FIG. 15 is a side view of the shaft that interconnects between the pair of components, one as shown in FIG. 2, which form the connectable member of this invention.

The relationship between the formed recess 19, and the offset recess 22, is more accurately shown in the side view disclosed in FIG. 13. Likewise, the aperture 21 in which the shaft 8 locates, during the connectable member assembly, in its attachment to the underside of the table top T, can also be seen. And, FIG. 15 shows the style of shaft 8 that may permanently locate within the apertures 21 of a pair of these components 5 and 6 that form the connectable member 4 of this invention.

Figure 11:
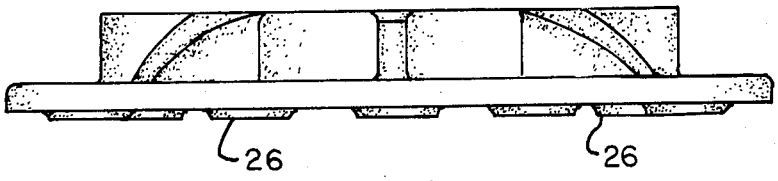
FIG. 11 is a side view of the component shown in FIG. 10.
Figure 12:
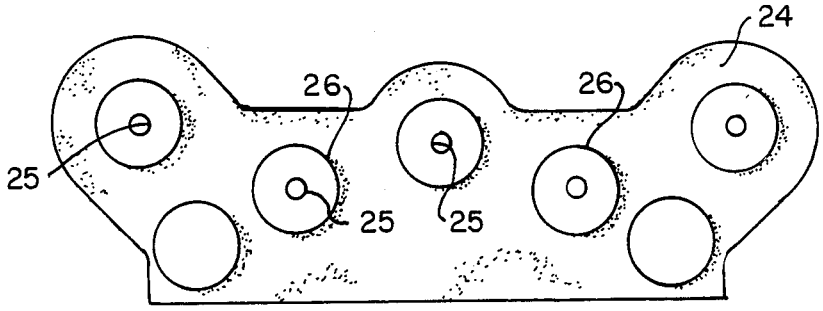
FIG. 12 is a top view of the component of FIG. 10.

In addition, as can be seen in FIGS. 11 through 13, at the location of each formed aperture 25, and through which a screw or other fastener may locate, there may be formed arranged and integral boss, as at 26, in order to assure a perfect and horizontal alignment connection of each connectable member 4 to the underside of the table top, to assure the horizontal arrangement of the table top in its mounting upon the column C.

Figure 17:
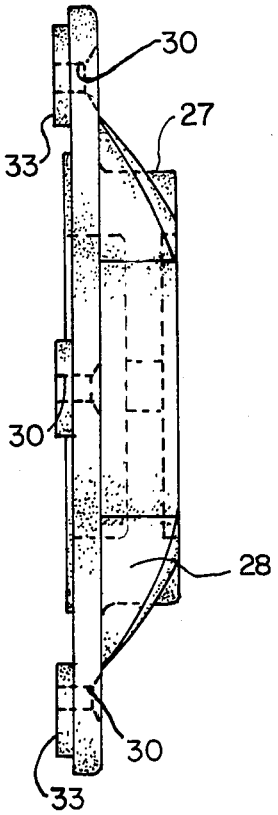
FIG. 17 is a side view of the column base shown in FIG. 16.
Figure 16:
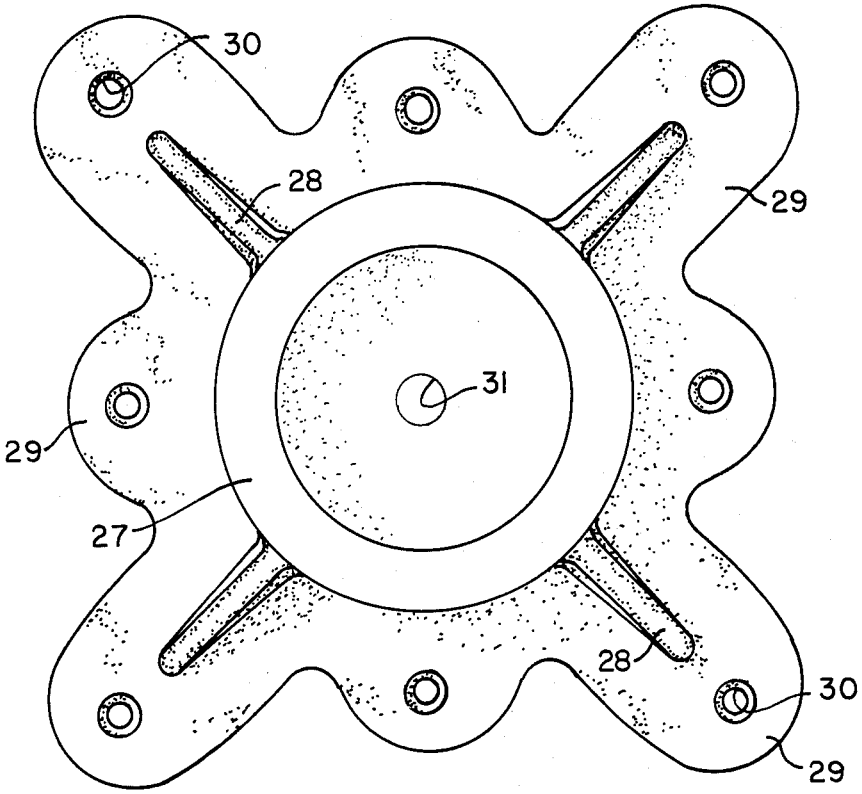
FIG. 16 is a top view of the column base.
Figure 18:
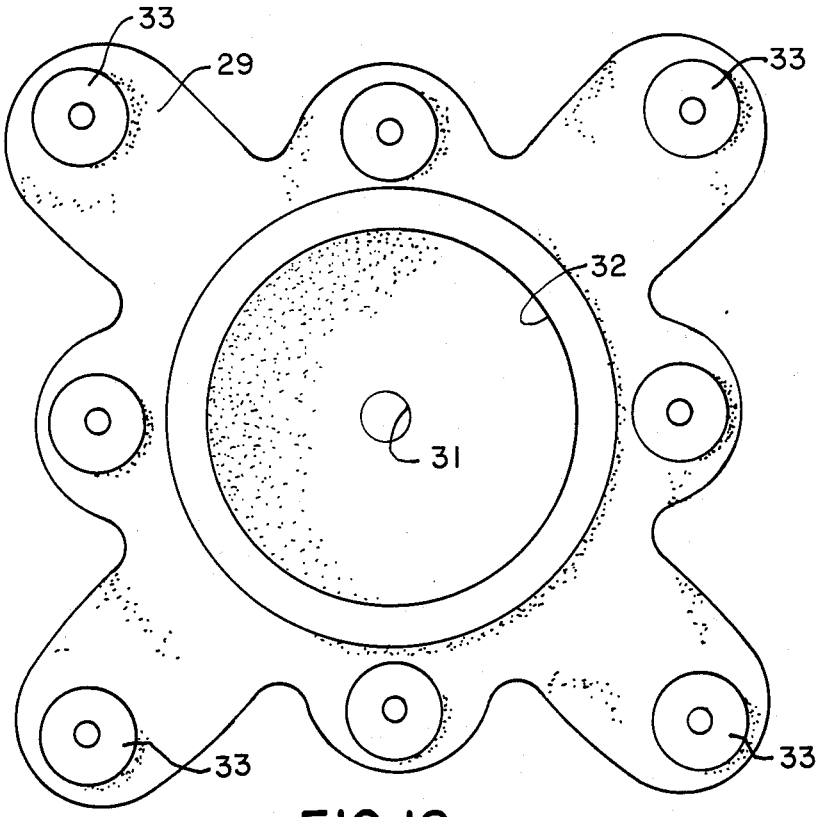
FIG. 18 is a bottom view of the column base shown in FIG. 16.

FIGS. 16 through 18 disclose one style of base that may be used in conjunction with the column C of the table, and for use for stably supporting the table upon the ground. In this particular instance, the base means is cast, and includes an upstanding collar 27 which has integrally formed with it a series of reinforcing ribs 28, and includes integrally extending flanges, as at 29, as shown, including a series of apertures at 30, therethrough, for reception of screws, or other fasteners, for mounting of the base means upon any form of standard (not shown) for stably supporting the entire table upon the floor. Once again, there is an aperture, as at 31, provided centrally of the base means, and through which a bolt or other fastener may secure, for tightly binding of the bottom of the column C to its base. Obviously, while the base means shown is desirable from the standpoint of provided a metallically cast base that may stably support the entire table erected, as during usage, it also adds significant stability to the table as it is being moved to other locations, as during storage. In addition, the particular style of base as herein shown is complementary in appearance to the connectable member components 4, as previously defined. The bottom side of the base means includes a recessed portion, as at 32, in order to assure that adequate clearance is provided for setting of the base upon its standard. And, to assure proper horizontal alignment for the entire table, a series of shallow bosses, as at 33, extends slightly downwardly from the flanges 29, as can be seen, to add proper alignment to the entire structure.

Figure 19:
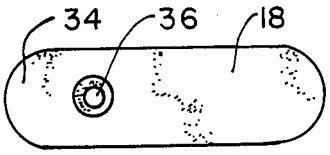
FIG. 19 is a top view of the locking means latch of this invention.
Figure 20:
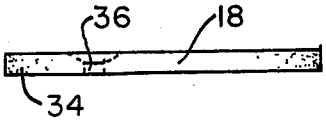
FIG. 20 is a side view of the latch shown in Figure 19.

As can also be noted in FIGS. 19 and 20, a type of latch mechanism 18 for use in conjunction with the locking means of this invention is shown. As can be seen, latch 18 has sufficient length so as to provide one end for ease of manipulation, as by the hand, while the opposite end, as at 34, is conveniently disposed for sliding into the slot 17, of the base member, in order to lock the table into its usable and horizontally disposed position. A fastener, as shown at 35, may locate through the aperture 36, provided within the latch means 18, to provide a pivot point about which this latch mechanism may be turned when manipulated into its locking, or disengaged, positions.

Figure 21:
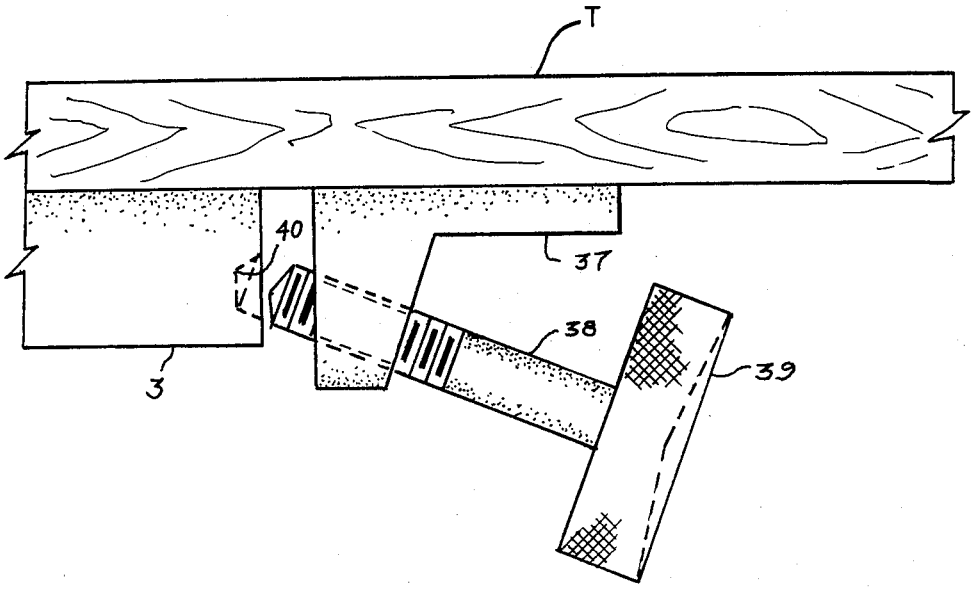
FIG. 21 is a view of an alternative type of locking means for use in conjunction with the table top support.

FIG. 21 discloses an alternative locking means for holding the table top support into position when engaged. For example, the table top T is disclosed having the first support member 3 maintained contiguously against its bottom surface. For purposes of clarification, the second member components 5 or 6 have been removed from view. An angle means 37 is mounted to the underside of the table, and has a threaded screw 38, incorporating a knob 39, threadedly secured therethrough. Hence, when the table top T is pivoted into its operative position, resting upon the first support member 3, the threaded member 38 can be tightened into position, within the groove 40 provided at the proximate end of the said support member 3, to thereby lock the table top into position upon the support member 3, in addition to its connected column C. When it is desired to repivot the table top into its upward position, as shown in FIG. 1, or to remove the same, one need only to unscrew the member 38, while applying manual force upon its knob 39, to unseat it from within the groove 40, thereby disengaging this locking means from the said support member 3.

Variations or modifications to the structure of this invention may occur to those skilled in the art upon reviewing the subject matter of this disclosure. Such variations, if within the spirit of this invention, are intended to be encompassed within the scope of any claims to patent protection issuing upon the same. The description of the preferred embodiment set forth herein, and the drawings as disclosed, are provided for illustrative purposes only.

Having thus described the invention, what is claimed and desired to be secured by Letters Patent is:

1. In a table top support for use in securing the top of a table at its underside to its upstanding column, and with said table top capable of pivoting between a horizontally disposed and usable position upon its column, or being pivoted to a vertical and storage position upon the same column, comprising, said support incorporating a pair of first and second mating members, the first mating member comprising a base member securing to the top of said column, the second mating member comprising a connectable member securing with the under surface of the said table top and being removably attachable with the base member and being capable of adherence through a first shaft means located proximate one edge of the connectable member and cooperating with a proximate edge of the base member for providing pivotal support for the table top upon its supporting column, said proximate edge of the base member including a formed recess therein, said base member recess extending across the said base member proximate its edge and being aligned with the said first shaft means of the connectable member and capable of receiving the same therein during table usage, said formed base member recess having another and communicating offset portion whereby the first said shaft means being received and retained therein during pivoting of the table top from its usable horizontal and useful position and to a proximate vertical and storage position, said formed recess of the base member opening upwardly and its offset portion exending from the said recess and in a direction towards the center of the structured table, wherein the said formed offset portion in cooperation with the said first shaft means tending to seat the said shaft within said base member recess as during the pivot of the table top between its usable and storage positions, a second shaft means located proximate an opposite edge from the formed base member recess and cooperating with the connectable member to stably support the said table top in its usable position upon its column, said connectable member having at least one recess formed therein and disposed for reception of the base member second shaft means therein, said connectable member recess having a communicating offset portion formed therewith, whereby the said second shaft means being received and retained within said base member recess while the table top is maintained in its horizontal and usable position, said connectable member formed recess opening downwardly and its offset portion extending from the said formed recess in a direction towards the center of the structured table, wherein said connectable member recess with its offset portion in cooperating with the said second shaft means of the base member tending to seat the said base member shaft means within the said connectable member recess during a pivoting of the table top between its usable and storage positions, wherein said first shaft means of the connectable member aligned for seating within the base member recess and said second shaft means of the base member being aligned for simultaneous seating within the connectable member recess while said table top is disposed in said horizontal and usable position upon the upstanding column, and whereby the said table top and its attaching connectable member is capable of pivoting in two directions about both of the said first and second shaft means when maneuvering the said table top from its horizontal and usable position to the vertical and storage position.

2. The invention of claim 1 and including locking means operatively associated between the column base member and at least one of the table top and connectable member for stably fixing said members together as during table usage.

3. The invention of claim 2 and wherein said locking means including a pivotal latch securing with the underside of the table top, and a formed slot provided within an approximate edge of the base member support, whereby said latch is capable of pivoting between a locking position within said disposed slot for rigidly securing the table top with its base member support column, and said latch is capable of pivoting into an unlocked position free of said base member slot.

4. The invention of claim 2 and wherein said connectable member being formed of two components, said components being spaced apart a distance slightly greater than the width of the said base member, said base member during table top erection being matingly disposed at least partially intermediately of the two said connectable member components.

5. The invention of claim 4 and wherein said second shaft means extends a short distance laterally from the base member, and the spaced apart connectable member components having aligned recesses formed therein comprising the said connectable member recess and disposed for reception of the said extended second shaft means during the arrangement of the table top in an operative position upon its supporting column.

6. The invention of claim 5 and including locking means operatively associated between the column base member and at least one of the underside of the table top and connectable member for stably fixing the said members together as during table usage.

7. The invention of claim 6 and wherein said locking means including a pivotal latch securing with the underside of the said table top, and a formed slot provided proximate an edge of the base member support, whereby said latch capable of pivoting between a locking condition within said disposed slot for rigidly securing the table top with its base member support column, or into an unlocked condition free of said base member slot.

8. The invention of claim 2 and wherein said locking means including a flange means, secured to the underside of the table top, a screw means threadedly engaging within said flange means, said screw means approximately aligned with one edge of the base member, such that when said screw means is further threaded through the flange means it tightens and locks against the said base member, thereby securing said table top upon its upstanding column support.

* * * * *